United States Patent [19]

Gamblin

[11] Patent Number: 4,554,219

[45] Date of Patent: Nov. 19, 1985

[54] SYNERGISTIC BRIGHTENER COMBINATION FOR AMORPHOUS NICKEL PHOSPHORUS ELECTROPLATINGS

[75] Inventor: Rodger L. Gamblin, Dayton, Ohio

[73] Assignee: Burlington Industries, Inc., Greensboro, N.C.

[21] Appl. No.: 615,271

[22] Filed: May 30, 1984

[51] Int. Cl.[4] ..... C25D 5/12

[52] U.S. Cl. ..... 428/667; 204/40; 204/41; 204/44.7; 428/672; 428/680

[58] Field of Search ..... 204/44.7, 41, 40; 428/680, 672, 667

[56] References Cited

U.S. PATENT DOCUMENTS

| | | | |
|---|---|---|---|
| 2,643,221 | 6/1953 | Brenner et al. | 204/44.7 |
| 2,644,787 | 7/1953 | Bonn et al. | 204/44.7 |
| 4,160,049 | 7/1979 | Narcus | 427/277 |
| 4,268,584 | 5/1981 | Ahn et al. | 428/620 |

FOREIGN PATENT DOCUMENTS

| | | | |
|---|---|---|---|
| 84469 | 7/1981 | Japan | 428/680 |

OTHER PUBLICATIONS

J. K. Dennis et al., "Nickel and Chromium Plating", p. 81, (1972).

Burns and Bradley, "Protective Coatings for Metals", ACS Monograph, No. 163, Reinhold, p. 220, (1960).

*Primary Examiner*—G. L. Kaplan

*Attorney, Agent, or Firm*—Cushman, Darby & Cushman

[57] ABSTRACT

Leveling of amorphous nickel-phosphorus electroplating is achieved by the combined synergistic action of a class II brightener and an organic acid having the formula $$R—COOH$$

wherein R is hydrogen, alkyl having 1–5 carbon atoms, $NH_2CH_2$—, $CH_3CHOH$—, $HOCH_2$—, or $ClCH_2$—. The bright, leveled, amorphous nickel-phosphorus coating may be made brighter by overplating with chromium, or other metals, to produce an object (such as cutlery, watch bezels and the like) having the desired properties.

19 Claims, No Drawings

SYNERGISTIC BRIGHTENER COMBINATION FOR AMORPHOUS NICKEL PHOSPHORUS ELECTROPLATINGS

FIELD OF THE INVENTION

This invention relates to a synergistic brightener combination for amorphous nickel-phosphorus electroplated coatings, and in particular to the combination of certain low molecular weight organic acids with class II brighteners.

BACKGROUND OF THE INVENTION

Electroplating comprises the adherent electrodeposition of a layer or coating of one conductive material onto another. A plating bath is generally set up by dissolving an amount of a metal salt or other compound in an aqueous solvent. The salts dissociate into their respective metal cations and anions, and the cations are reduced to metal on the surface of a conductive object which has been made the cathode in the bath. The anode is generally fabricated of the same metal which is to be deposited, thus assuring a constant supply of ions and negating the chance for contaminating the bath.

The above simplistic description fails to indicate, however, the myriad complexities which go into determining the smoothness (and, hence, often the utility) of the electroplated coating, and a variety of substrate preparation steps (cleaning, rinsing, acid dipping, etc.) are frequently implemented as part of the overall electroplating process. Failure to properly treat the substrate can often result in the failure to achieve a bright, shiny, smooth coating, a feature which not only is of great practical significance when, for example, considering metal-on-metal contact, wear and longevity, but which is also of obvious significance in creating an attractive product for marketing purposes.

Even with proper substrate preparation, dull or matte surfaces can still occur depending on the substrate and on the metal or other conductive substance being electroplated thereon. Accordingly, certain bath additives termed brighteners have been developed because they provide a microscopic smoothing action which allows a finish that is bright and shiny to the naked eye. Although brightening mechanisms are not fully understood, one form of brightening is thought to occur through a process known as "leveling" whereby metal is removed from the high spots of microscopic ripples or irregularities without at the same time being removed from low spots or valleys (see *Encyclopedia of Chemical Technology*, Kirk-Othmer, Volume 15, pp. 296–303, John Wiley & Sons, Third Edition).

Brighteners for nickel plating baths are generally lumped into two broad categories. The first is known as class I and includes compounds such as naphthalenedisulfonic acids, diphenylsulphonates, aryl sulfonamides, sulfonimides, etc. These brighteners generally improve brightness on pre-polished substrates but do not "build" luster on rough surfaces. The second is known as class II and includes certain metal ions and unsaturated organic compounds that are strongly adsorbed on the cathode. This class is fairly broad, a non-limiting list of commonly known representative members including propargyl alcohol, urea, pyridine, acetone, formaldehyde and water-soluble acetylenes such as dimethylhexynediol and butynediol (see Burns and Bradley, *Protective Coatings for Metals*, ACS Monograph No. 163, Reinhold, p. 220). Class II brighteners are thought to work through the leveling mechanism described above.

Most brightening formulations contain a combination of a class I brightener, which can be used in large amounts and which does not affect ductility, with a class II brightener which creates brittle and highly stressed finishes.

Such brightening formulations as described above, although useful for many applications, exhibit serious drawbacks with respect to nickel-phosphorus coatings, however. Nickel-phosphorus coatings themselves are highly desirable inasmuch as they are extraordinarily resistant to corrosion when the phosphorus content is above about 12 atomic percent. They exhibit very little leveling tendency, however, and appear to be affected only detrimentally by class II brighteners. That is, what little leveling can be obtained on nickel-phosphorus with a class II brightener generally occurs at the expense of reduced corrosion resistance.

Further, at or above a phosphorus level of about 12 atomic percent, nickel-phosphorus alloys are amorphous, i.e. they exhibit no defined crystal structure. Thus they are also largely unaffected by class I brighteners which operate by modifying the crystal structure of an electrodepositable substance as it forms on the substrate.

What is needed for this valuable class of alloy coatings is a brightening agent or combination of agents which will allow smoothing of a nickel-phosphorus electroplate. Such would improve the appearance of nickel-phosphorus coatings in their own right and also provide a smooth surface on which bright decorative overplating (e.g. with chromium) would be possible, chromium overplating on nickel-phosphorus as deposited by present methods generally appearing somewhat matte. Smooth nickel-phosphorus coatings would also be improved in longevity in applications involving metal-on-metal wear and abrasion. Such a brightening combination is the subject of this invention.

SUMMARY OF THE INVENTION

This invention provides a synergistic combination of chemical agents which together provide superior leveling on nickle-phosphorus coatings deposited from an aqueous plating bath. Specifically, the combination includes at least one compound from each of two classes. The first class consists of class II brighteners previously mentioned, i.e. those compounds which are presently known to act as brighteners through the leveling mechanism previously discussed. The second class (herein also referred to as class X for the sake of convenience) consists of low molecular weight organic acids having the generic formula:

$$R—COOH$$

wherein R is selected from the group consisting of hydrogen, alkyl having 1–5 carbon atoms, $NH_2CH_2$—, $CH_3CHOH$—, $HOCH_2$—, and $ClCH_2$—. The compounds represented by the class therefore include formic, acetic, propionic, and butyric acids, hydroxyacetic and chloroacetic acids, glycine, and lactic acid.

That a class II compound along with a class X compound should serve as an effective brightening combination for nickel-phosphorus is indeed surprising. Class X compounds alone have been determined to exhibit only a very subtle leveling action on nickel-phosphorus such that their unaugmented action would not be useful for producing chromium-overplatable nickel-phosphorus coatings. Class II compounds generally produce only detrimental effects, if any effects at all. Thus it was unexpected that good leveling action would be produced by combining chemicals which barely level with chemicals that produce no or only detrimental effects.

According to the invention a method of producing a leveled electroplated coating is provided. The method comprises the steps of (a) adding to an electroplating bath having nickel and phosphorus ions as the main operative constituents thereof, at least one compound selected from the group consisting of class II brightening agents; and at least one organic acid selected from the group having the formula

R—COOH wherein R is alkyl having 1–5 carbon atoms, hydrogen, $NH_2CH_2$—, $CH_3CHOH$—, $HOCH_2$—, or $ClCH_2$— [the class II and class X compound should each be added in an amount such that their combined action is sufficient to achieve the desired extent of leveling]; (b) maintaining the bath concentration, temperature, and current density conditions so that objects immersed therein will have a coating of amorphous nickel and phosphorus formed thereon; and (c) immersing an object in the bath and removing the object when the surface thereof has a coating of leveled nickel and phosphorus.

The coated surfaces of objects produced also preferably have an overplating applied thereto. The overplating typically is a chromium overplating, although overplating with gold, white gold, titanium nitride, and silver is also possible.

When an overplating of chromium is applied, the object produced according to the invention comprises a surface of electrically conductive material upon which is a coating of level amorphous nickel-phosphorus, and an overplating of chromium.

It is the primary object of the present invention to provide a method for producing leveled coatings, and the coatings so produced, utilizing amorphous nickel-phosphorus and an overplating. This and other objects of the invention will become clear from an inspection of the detailed description of the invention and from the appended claims.

DETAILED DESCRIPTION OF THE INVENTION

The combined leveling agents may, most simply, be added individually to a plating bath before starting the plating operation, and this is what the term "combination" is intended to cover, i.e. the presence in the bath of at least one compound from each of class II and class X. The compounds may advantageously be added individually and need not be pre-formulated as a mixture or composition, though addition to the bath of the ingredients as a mixture will serve the same purpose if convenience so dictates.

Useful basic nickel-phosphorus plating baths are in and of themselves known to the art and have been disclosed, for example, in U.S. Pat. No. 2,643,221 to Brenner et al, the entire disclosure of which is herein incorporated by reference.

The electroplated coatings to which this invention is applicable will generally contain at least about 12 atomic percent (about 7 weight percent) phosphorus, but in any event sufficient phosphorus should be present so that an amorphous nickel-phosphrous alloy results. As a practical matter, the upper limit of phosphorus will generally be about 25 atomic percent (about 15 weight percent).

The useful temperature range for operating nickel-phosphorus baths is from about 75° to about 95° C., the baths generally not operating manageably at extremes much outside this range. That is, at bath temperatures much below 75° C. cathode efficiency is relatively poor, while at temperatures exceeding 95° C. evaporation of the bath becomes a problem.

The most useful range of current density for plating nickel-phosphorus can vary reasonably widely from about 25 to about 400 milliamperes per square centimeter ($ma/cm^2$), and current densities over 400 $ma/cm^2$ are also practical.

The most useful pH range for plating baths used in accordance with this invention is between about 0.5 and about 2.

The thickness of the amorphous nickel-phosphorus coating is not usually critical, but will normally be in the range of about 25–1000 microinches. The coating only need be thick enough to get the desired results.

It must be cautioned that the powerful leveling combinations described herein generally require the presence of a suitable surfactant to avoid pitting of the nickel-phosphorus deposit. One class of suitable surfactants is alkoxylated linear alcohols, a particularly suitable example of which is Chemal LF-25B (Chemax, Inc., Greenville, S.C.). Additional suitable surfactants include a number of fluorocarbon surfactants, specifically those of the Zonyl series (Trademark of E. I. DuPont de Nemours, Inc.). Other surfactants which might be more commonly known such as sodiumm lauryl sulfate are less useful inasmuch as they hydrolyze under the hot acidic bath conditions employed. It is believed that the alleviation of pitting is simply a consequence of lowering the bath surface tension by the surfactant.

The inclusion of phosphoric acid in any of the baths mentioned herein is advantageous in that phosphoric acid per se provides an additive contribution to the leveling action, although the contribution is small relative to the synergistic combination of class II and class X brighteners. Thus, although phosphoric acid is not in and of itself an adequate leveling agent, its inclusion in an amount between about 0.1 and 0.5 molar does provide a small leveling effect, in addition to which it also alleviates stress in the plating. A particularly preferred level of phosphoric acid in the bath occurs at about 0.3 molar.

The following examples illustrate several suitable basic plating baths. By "basic plating bath" it is intended to denote baths which contain constituents sufficient to yield an amorphous nickel-phosphorus coating, but not the leveled nickel-phosphorus coatings made possible by the additive combinations of this invention. One basic bath which may be used is the so-called Ni-H bath described in the aforementioned U.S. Pat. No. 2,643,221, reproduced as Example 1 following:

EXAMPLE 1

0.57 moles/liter $NiSO_4.6H_2O$
0.11 moles/liter $NiCl_2.6H_2O$
0.24 moles/liter $NiCO_3$
0.5 moles/liter $H_3PO_3$
0.5 moles/liter $H_3PO_4$ An aqueous bath containing the above components has been used to plate satisfactory coatings of amorphous nickel-phosphorus at 80° C. and at a current density of about 200 ma/cm$^2$ using an inert anode of platinized titanium. In general, the pH of this bath should be maintained between about 0.7 and about 2. Cobalt may replace some of the nickel. The amorphous nickel-phosphorus coating itself has good brightness properties, and even better properties are provided when it is overplated (e.g. with chromium).

Somewhat better cathode efficiency, albeit accompanied by slightly greater tensile stress in the plating, may be achieved by the following basic aqueous bath, set forth as Example 2:

EXAMPLE 2

0.75 moles/liter $NiCl_2.6H_2O$
0.25 moles/liter $NiCO_3$
1.2 moles/liter $H_3PO_3$ The above bath provides satisfactory amorphous nickel-phosphorus plates at 75°–85° C. and at a current density of about 200 ma/cm$^2$ using either an inert or nickel anode. In general, the pH of this bath should be maintained between about 0.5 and about 1.5.

The baths of Examples 1 and 2 are highly tolerant to cations having a high reduction potential such as calcium, manganese, magnesium, aluminum, lithium, sodium, beryllium, and potassium. That is, the cations will not codeposit as impurities at the potentials used to effect deposition of nickel-phosphorus. The baths generally are not tolerant to contaminants which are more easily reduced such as copper, lead, selenium, tellurium, or tin.

Generally speaking, materials containing amino groups have been found to be detrimental to bath operation, i.e. a rough, relatively pitted plating is produced, with the exception of $\beta$-alanine, glycine and urea. Short chain diacids including malic, maleic, malonic, and succinic acid may also exhibit harmful effects, albeit the effects are not as deleterious as with short chain amines.

The following baths, comprising one of the basic baths previously described plus the leveling combinations and surfactant indicated, have been found to provide efficient leveling action not heretofore seen with nickel-phosphorus electroplates:

EXAMPLE 3

To the bath of Example 2, the following combinations of ingredients was added:

40 ml/liter glacial acetic acid
0.06 ml/liter Chemal LF-25B*
6 ml/liter 37% formaldehyde solution. *Chemax, Inc., Greenville, S.C., brand alkoxylated linear alcohol.

EXAMPLE 4

To the bath of Example 1, the following combination of ingredients was added:

12 gm/liter urea
40 ml/liter hydroxyacetic acid
0.06 ml/liter Chemal LF-25B.

EXAMPLE 5

To the bath of Example 2 the following combination of ingredients was added:

40 ml/liter glacial acetic acid
0.06 ml/liter propargyl alcohol
0.06 ml/liter Chemal LF-25B.

EXAMPLE 6

To the bath of Example 2 the following combination of ingredients was added:

20 ml/liter glacial acetic acid
60 ml/liter acetone
0.06 ml/liter Chemal LF-25B.

Each of Examples 3–6 discloses an additive combination for use in the basic baths of Examples 1 or 2, each additive combination comprising a synergistic leveling combination of a Class II and Class X compound, plus a small amount of surfactant to prevent pitting of the substrate. Each of the above baths 3–6 permitted bright chromium overplating (by methods known in the art) onto the amorphous nickel-phosphorus layers provided by the bath. Substrates used were iron, brass, copper, steel, stainless steel, zinc, aluminum (following treatment with a zincating solution), and ceramics whose surfaces had been previously rendered conductive by means of a thin electroless nickel overcoating.

Overplating with other metals and alloys besides chromium is also possible. For example, for some end uses overplating may be with gold, white gold, silver, and titanium nitride. Typical plated objects that may be produced include cutlery, watch bezels, and bottoms of frying pans. These are representative examples only. The end products produced will not, however, typically be used in applications where their electrical properties are important, but rather where appearance and strength are important.

Acetic acid and hydroxyacetic acid are preferred as class X components.

It should be noted that, although the basic baths of Examples 1 and 2 are desirable inasmuch as concentrations for the particular ingredients noted have been optimized, the concentrations noted are not critical. That is, the concentrations can be varied quite widely without producing gross differences in plating quality, although subtle differences, e.g. in the electroplate stress, will probably occur. In fact, the particular ingredients used to formulate these baths are cited as exemplary inasmuch as they are quite tolerant to relatively large fluctuations in the proportion of ingredients.

In general, the total concentration of nickel in the bath, in the form of whatever salt or salts are chosen, can vary up to about 2.5 molar. The amount of phosphorus to be electroplated, present as phosphorous acid, can vary between about 12 and about 180 grams/liter.

The concentration of class II brightener can vary markedly depending on the specific brightener being employed, and to a certain extent on the class X brightener being employed in combination therewith. Acetone, for example, can be used fairly heavily, as high as 1 part in 15 (v/v). Butynediol, by contrast, is generally used much more lightly, 50 ppm (parts per million) being a typical concentration. Determination of efficacious concentrations of class II brighteners may be routinely ascertained by those skilled in the art by means of empirical studies or trial runs.

The concentration of class X brighteners similarly can vary depending upon the specific brightener. In general, the concentration will vary (v/v basis) from about 1 part in 60 to about 1 part in 10. A typical concentration of acetic acid, for example, is 1 part in 20 to 30. Optimization of class X concentration by those skilled in the art is again well within the scope of this invention.

The concentration of surfactant may vary from about 50 ppm to about 500 ppm.

The basic bath-plus-additive combinations can be operated under the conditions (temperature, current density, pH) previously noted, and, advantageously, no modifications to the basic baths are needed. Advantageously, agitation of the bath by techniques well known to the art may be provided.

It will therefore be seen that the leveling combinations of this invention provide leveling of nickel-phosphorus coatings which in turn allows bright, protective chromium overplating.

Although only a few exemplary embodiments of this invention have been described in detail above, those skilled in the art will readily appreciate that many modifications are possible in the exemplary embodiments without materially departing from the novel teachings and advantages of this invention. Accordingly, all such modifications are intended to be included within the scope of this invention as defined in the following claims.

What is claimed is:

1. A method producing a leveled electroplated coating comprising the steps of:

(a) adding to an electroplating bath including nickel and phosphorus ions as the primary constituents thereof, at least one compound selected from the group consisting of unsaturated organic compounds that are class II brightening agents, and at least one organic acid in an amount between one part in 60 and one part in 10, based on the volumes of the organic acid and the bath, respectively selected from the group having the formula

R—COOH wherein R is alkyl having 1–5 carbon atoms, hydrogen, $NH_2CH_2$—, $CH_3CHOH$—, $HOCH_2$—, or $ClCH_2$—; the amount and type of unsaturated organic compound class II brightening agent being selected so as to cooperate with said organic acid to enhance leveling;

(b) immersing an object to be electroplated, and removing the object once electroplated, so that it has at least one surface thereof with leveled amorphous nickel-phosphorus electroplated thereon, and (c) overplating the leveled amorphous nickel-phosphorus coating with chromium.

2. A method as recited in claim 1 wherein the organic acid is selected from the group consisting of acetic acid and hydroxyacetic acid.

3. A method as recited in claim 2 wherein the bath is maintained at a temperature of between about 75° C.–95° C.

4. A method as recited in claim 3 wherein electroplating further practiced by maintaining the current density between about 25–400 ma/cm$^2$.

5. A method as recited in claim 4 wherein the pH of the bath is maintained between about 0.5–2.

6. A method as recited in claim 5 wherein the object immersed has an electrically conductive surface on which amorphous nickel-phosphorus is electroplated.

7. A method as recited in claim 2 wherein step (a) is further practiced by adding a surface active agent to the bath.

8. A method as recited in claim 2 wherein the object immersed has an electrically conductive surface on which amorphous nickel-phosphorus is electroplated.

9. A method as recited in claim 1 wherein electroplating is further practiced by maintaining the current density between about 25–400 ma/cm$^2$.

10. A method as recited in claim 1 wherein electroplating is further practiced by maintaining the pH of the bath between about 0.5–2.

11. A method as recited in claim 1 wherein electroplating is practiced by maintaining the bath at a temperature of between about 75° C.–95° C.

12. A method as recited in claim 1 wherein step (a) is further practiced by adding a surface active agent to the bath.

13. A method as recited in claim 12 wherein the surface active agent is alkoxylated linear alcohol.

14. A method as recited in claim 1 wherein the object immersed has an electrically conductive surface on which amorphous nickel-phosphorus is electroplated.

15. A coated object comprising:

a base surface of electrically conductive material;

a level coating of amorphous nickel-phosphorus on said surface; and a bright overplating of chromium on said level amorphous nickel-phosphorus coating.

16. An object as recited in claim 15 wherein the coating of nickel-phosphorus is between about 25–1000 microinches thick.

17. A method producing a leveled electroplated coating comprising the steps of:

(a) adding to an electroplating bath including nickel and phosphorus ions as the primary constituents thereof, at least one compound selected from the group consisting of unsaturated organic compounds that are class II brightening agents, and at least one organic acid in an amount between one part in 60 and one part in 10, based on the volumes of the organic acid and the bath, respectively selected from the group having the formula

R—COOH wherein R is alkyl having 1–5 carbon atoms, hydrogen, $NH_2CH_2$—, $CH_3CHOH$—, $HOCH_2$—, or $ClCH_2$—; the amount and type of unsaturated organic compound class II brightening agent being selected so as to cooperate with said organic acid to enhance leveling;

(b) immersing an object to be electroplated, and removing the object once electroplated, so that it has at least one surface thereof with leveled amorphous nickel-phosphorus electroplated thereon, and (c) overplating the amorphous nickel-phosphorus coating with a material selected from the group consisting of gold, white gold, titanium nitride, and silver.

18. A method as recited in claim 17 wherein the organic acid is selected from the group consisting of acetic acid and hydroxyacetic acid.

19. A method as recited in claim 18 wherein step (a) is further practiced by adding a surface active agent to the bath.

* * * * *